US007455359B2

(12) United States Patent
Rönning

(10) Patent No.: US 7,455,359 B2
(45) Date of Patent: Nov. 25, 2008

(54) ROCKING CHAIR

(76) Inventor: Lennart Rönning, Järnvägsgatan 11, SE-262 32 Ängelholm (SE)

( * ) Notice: Subject to any disclaimer, the term of this patent is extended or adjusted under 35 U.S.C. 154(b) by 0 days.

(21) Appl. No.: 10/574,906

(22) PCT Filed: Oct. 8, 2004

(86) PCT No.: PCT/SE2004/001433

§ 371 (c)(1),
(2), (4) Date: Feb. 6, 2007

(87) PCT Pub. No.: WO2005/032307

PCT Pub. Date: Apr. 14, 2005

(65) Prior Publication Data

US 2007/0216206 A1 Sep. 20, 2007

(30) Foreign Application Priority Data

Oct. 8, 2003 (SE) ..... 0302653

(51) Int. Cl.
*A47C 3/02* (2006.01)
*A47C 3/023* (2006.01)
*A63G 9/00* (2006.01)

(52) U.S. Cl. ..... 297/270.1; 297/258.1; 297/259.3; 297/271.4; 297/273; 297/277; 297/281

(58) Field of Classification Search ..... 297/264.1, 297/273, 277, 258.1, 259.3, 271.4, 278, 270.1, 297/270.2, 270.4, 281, 282
See application file for complete search history.

(56) References Cited

U.S. PATENT DOCUMENTS

| | | | | |
|---|---|---|---|---|
| 318,673 | A * | 5/1885 | Wilcox | 297/270.1 X |
| 731,197 | A * | 6/1903 | Marqua | 297/281 X |
| 4,536,029 | A | 8/1985 | Rogers, Jr. | |
| 5,897,462 | A * | 4/1999 | St. Germain | 297/270.1 X |
| 6,318,803 | B1 * | 11/2001 | Garland | 297/259.2 X |
| 6,588,841 | B1 | 7/2003 | Hoffman et al. | |
| 6,971,977 | B1 * | 12/2005 | Chen | 297/258.1 X |
| 7,134,720 | B2 * | 11/2006 | Viger | 297/270.1 |
| 7,322,650 | B2 * | 1/2008 | Chouinard et al. | 297/270.2 |
| 7,334,840 | B2 * | 2/2008 | Deans et al. | 297/270.1 |

FOREIGN PATENT DOCUMENTS

| | | | |
|---|---|---|---|
| CA | 2 268 222 | A1 | 10/2000 |
| DE | 199 44 114 | A1 | 4/2001 |
| DE | 202 00 298 | U1 | 4/2002 |
| WO | WO-93/08716 | A1 | 5/1993 |

* cited by examiner

*Primary Examiner*—Rodney B. White
(74) *Attorney, Agent, or Firm*—Birch, Stewart, Kolasch & Birch, LLP

(57) ABSTRACT

A rocking chair (1) comprising a frame (3) and a seat (2) which is swingable relative to the frame (3). The rocking chair (1) is characterised by a leg (4) and a swing mechanism (5). The leg (4) comprises a first upper (14) and a second lower end (15). The first end (14) is articulated to the seat (2) and the second end (15) is articulated to the frame (3). The swing mechanism (5) comprises a swinging arm (21) which has its pivot (22) arranged in the frame (3). The free end (23) of the swinging arm (21) is articulated to the seat (2) in such a manner that the free end (23) of the swinging arm (21) is arranged below the pivot (22) of the swinging arm (21).

10 Claims, 4 Drawing Sheets

ROCKING CHAIR

FIELD OF THE INVENTION

The present invention relates to a rocking chair comprising a frame and a seat swingable relative to the frame.

BACKGROUND ART

Traditional rocking chairs comprise a chair with arched rockers, in which the user can perform an arched rocking motion relative to the surface on which the rockers are standing. Depending on the length and radius of curvature of the rockers, the rocking motion can be both long and relaxing, but it may also be experienced as uncontrolled and violent. This type of rocking chair is associated with a great risk of injuries caused by squeezing of the user and especially injuries in other people who are in the vicinity of the rocking chair.

Another type of rocking chair comprises a rocking mechanism comprising a plurality of pendulums with a swinging arm that is either rigid or flexible. The flexible swinging arms consist of, for example, cords. The common feature of this type of rocking chair is that the seat is supported by two or more pairs of swinging arms.

An example of such a rocking chair of pendulum type is disclosed in WO 93/08716 which relates to a rocking chair comprising a stationary frame, a seat and two pairs of swinging arms. The seat is arranged at a first free end of each swinging arm to allow a movement backwards and forwards. Armrests are arranged at the second ends of the swinging arms, which results in an opposite movement of the armrest relative to the seat. The movements of the armrest and the seat, respectively, that arise make it easy for the user to sit down in the rocking chair since he presses his own weight against the armrests, whereby the seat is moved towards the user.

Another example of a rocking chair of pendulum type is disclosed in U.S. Pat. No. 4,536,029 which comprises a swing mechanism with four swinging arms. The swinging arms are arranged in pairs in the form of a front and a rear pair of swinging arms seen in the longitudinal direction of the rocking chair. The pairs of swinging arms form a trapezoid when looking at the chair sideways. Two sides diverge upwards, i.e. the distance between the upper fixing points of the pairs of swinging arms is greater than between the lower fixing points of the pairs of swinging arms. Such an arrangement implies that the seat does not obtain a transversal motion only, but also a rocking motion. The swinging arms included in the mechanism have a very short length, whereby they bear a great resemblance to a scissor type mechanism and involve great risks of injuries caused by squeezing. The mechanism is frequently found in armchairs where the rocking motion can be considered an exclusive feature. Therefore the mechanism is compact and integrated in the armchair in such a manner that it is not visible from the outside. This is a necessity in order to prevent injuries caused by squeezing. Moreover, the integral construction is necessary owing to the compactness since there would otherwise be a surface that would be difficult to clean.

There is thus a need for a simple and versatile rocking chair which allows a relaxing and controlled rocking motion and which also is safe.

OBJECTS OF THE PRESENT INVENTION

An object of the present invention is to provide a rocking chair having a motion pattern which gives the user a relaxing rocking motion.

Another object is to provide a construction which is stable for the user and which does not collapse when possibly being subjected to a high load.

Yet another object is to provide a rocking chair which is safe for people in the vicinity and where the risk of injuries caused by squeezing is reduced or completely eliminated.

SUMMARY OF THE INVENTION

To achieve at least one of the above objects, and also other objects that will be evident from the following description, a rocking chair according to the present invention is provided, having the features stated in claim 1. Preferred embodiments of the rocking chair will be evident from claims 2-10.

More specifically, a rocking chair is provided, comprising a frame and a seat swingable relative to the frame, said rocking chair being characterised by a leg comprising a first upper and a second lower end, which first end is articulated to the seat and which second end is articulated to the frame, and a swing mechanism comprising a swinging arm having its pivot arranged in the frame and its free end articulated to the seat in such a manner that the free end of the swinging arm is arranged below the pivot of the swinging arm.

This results in a rocking chair which provides a motion pattern that gives the user a smooth and relaxing rocking motion. Cooperation between the leg and the swinging arm occurs by the horizontal motion of the leg being essentially limited by the end positions for the motion of the swinging arm. The leg can easily be attached to the frame and the seat without unnecessary and expensive elements. Constructions involving one leg allows high stability which in turn allows the swing mechanism to be designed in an easy and uncomplicated manner since the leg can take up the major part of the forces by which the seat affects the frame. This results in a rocking chair having a simple and stable construction.

It is preferred for the leg to have a significantly greater swinging radius than the swinging arm. Since the swinging radius of the leg is significantly greater than that of the swinging arm, the deflection of the swinging arm will limit the reciprocating motion of the seat in such a manner that the motion will be controlled and pleasant for the user.

Moreover it is preferred for the leg to be articulated to the seat via a backrest included in the seat. Consequently the leg can be given a great length, which allows a smooth rocking motion. Due to its length, the leg can also be given such a curvature that a clearance is ensured between the backrest and the leg, whereby the rocking motion is not limited by the leg abutting against the backrest. The clearance further ensures that objects coming in between the two parts cannot be damaged or injured by squeezing. The curvature can also be made so as to make the rocking chair compact and, above all, aesthetically attractive.

It is preferred for the free end of the swinging arm to be articulated to the seat via a projection arranged on the underside of the seat. Moreover the pivot of the swinging arm is arranged on a supporting portion extending upright from the supporting points of the frame on a base.

This, combined with the fact that the free end of the swinging arm is arranged below the pivot of the swinging arm, implies that the swinging arm can be given a considerable length and, all the same, be contained under the seat. Thus the rocking chair can be made very compact. Moreover, a long swinging arm allows a greater swinging motion and, thus, a longer rocking motion. By the swinging arm being protected under the seat, the risk of injuries caused by squeezing is reduced.

The swinging arm can be either rigid or flexible. A rigid swinging arm allows the motions of the seat to be completely limited to the swinging motion performed by the swinging arm since a rigid swinging arm cannot be resilient by compression or expansion. This results in a stable and safe construction.

A swinging arm of a flexible material, such as saddle girth, allows very simple attachment. For instance, the ends of the swinging arm can be formed with loops and thus be easily mounted at its fixing points by the swinging arm being simply slipped onto shafts on which it can swing during its swinging motion. A flexible swinging arm can also be attached to and around a shaft, which allows that part of the swinging arm which is closest to the shaft to make a rolling motion about the shaft during the swinging motion. Such a construction gives a practically friction-free swinging motion. The use of a flexible swinging arm thus allows a very simple and inexpensive construction since traditional bearings, such as ball bearings, can be avoided.

It is also preferred for the linear distance between the first and second ends of the leg to be adjustable to set the inclination of the seat relative to a horizontal plane. Such an arrangement results in a chair, in which the angle of inclination of the seat can be controlled according to the manner in which the chair is to be used. Thus the chair obtains greater applicability. For instance, falling asleep can be facilitated if a more comfortable posture of lying can be provided. The linear distance can be changed, for example, by means of a telescopic leg or a leg with an adjustable and lockable knee joint, thus making is possible to angle the leg and also allowing a change of the linear distance between the first and second ends of the leg, and, thus, the angle of the seat.

Another preferred embodiment of the rocking chair comprises a locking mechanism for locking the position of the seat relative to the frame. Such a locking mechanism results in a rocking chair which makes it easy for the user to sit down in the rocking chair and rise therefrom. This is extremely useful if the user has limited mobility but yet desires to use the advantages of a rocking chair. A locking mechanism also provides a locked seat that is not dangerous at all for children, for example. A further advantage of a locking mechanism is achieved by the chair being allowed to be used for other purposes than for rocking and where a rocking seat is quite inappropriate, for instance at a dining table.

The ratio of the length of the swinging arm to the length of the leg is preferably in the order of 1:2 to 1:4 and most preferred in the order of 1:3.

BRIEF DESCRIPTION OF THE DRAWINGS

The invention will now be described in more detail by way of example and with reference to the accompanying drawings, which illustrate a currently preferred embodiment of the rocking chair according to the invention.

DESCRIPTION OF PREFERRED EMBODIMENTS

Figure 1A:
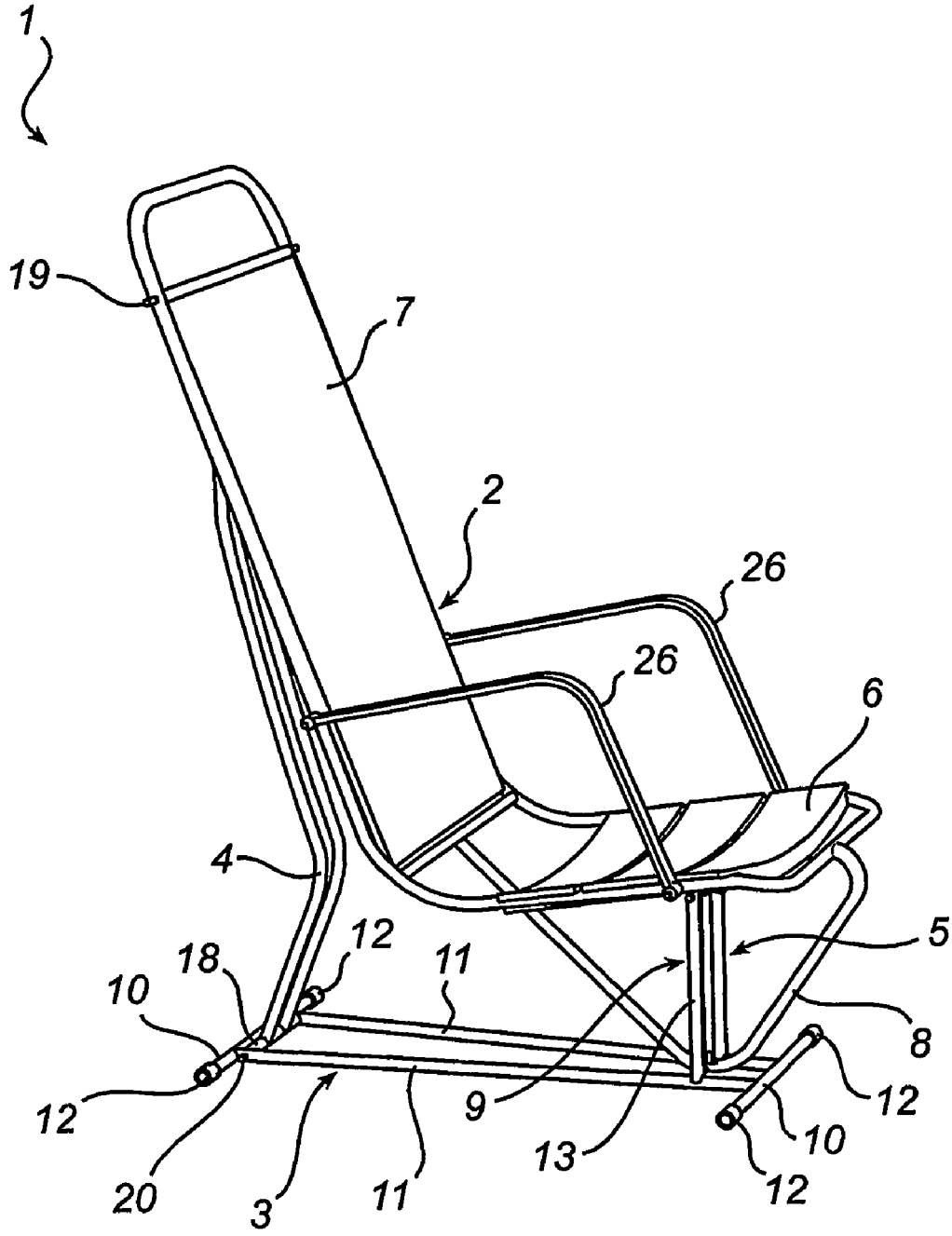
FIG. 1*a* is a perspective view obliquely from the front of the rocking chair in a position of rest.
Figure 1B:
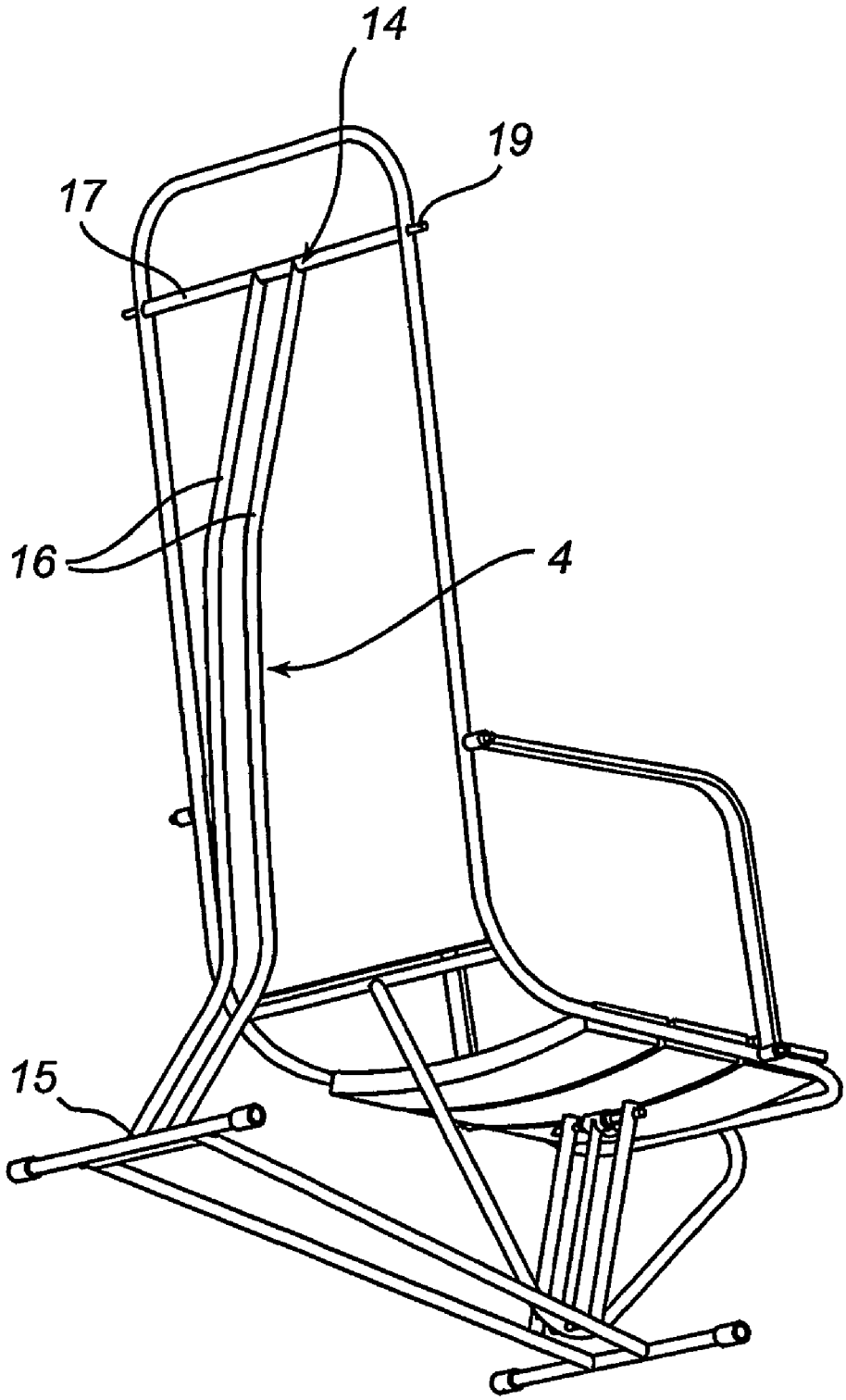
FIG. 1*b* is a perspective view obliquely from behind of the rocking chair in a position of rest.

With reference to FIGS. 1*a* and 1*b*, a rocking chair 1 according to the invention is shown in perspective from the front and from behind respectively. The rocking chair 1 comprises two main parts, viz. a seat 2 and a frame 3. The seat 2 is movably arranged relative to the frame 3 by cooperation between a leg 4 and a swing mechanism 5.

The seat 2 preferably comprises a bottom 6 and a backrest 7 which are fixedly connected to each other. The bottom 6 and the backrest 7 can also be mutually adjustable for setting an angle between them. In the embodiment illustrated, the seat 2 is designed as a frame of tubular sections forming a bottom 6 and a backrest 7. Of course, it will be appreciated that the construction of the bottom 6 and the backrest 7 is of minor importance.

The seat 2 has on the underside of the bottom a projection 8, the function of which will be described below. The projection 8 can be of various shapes, of which the one illustrated in FIGS. 1*a* and 1*b* is but one shape. The illustrated projection 8 is a tubular section which is formed as a U-shaped yoke whose legs are attached to the underside of the bottom 6 and whose web forms a fixing point for a free end 23 of the swinging arm 21 according to FIG. 2 which will be described below.

The primary function of the frame 3 is to provide a stable support on a floor surface and prevent unintentional tilting of the rocking chair 1.

In the embodiment shown, the support consists of a welded tubular construction comprising two spaced-apart horizontal, transverse tubular supporting surfaces 10 and two longitudinal horizontal struts 11 connecting the two transverse supporting surfaces 10. The two transverse supporting surfaces are at their ends provided with protective caps 12 to prevent scratching of a floor surface. Also the longitudinal horizontal struts 11 can advantageously form a supporting surface against the floor surface.

The frame 3 can, as will be appreciated, also be provided with a swivel function (not shown).

Figure 2:
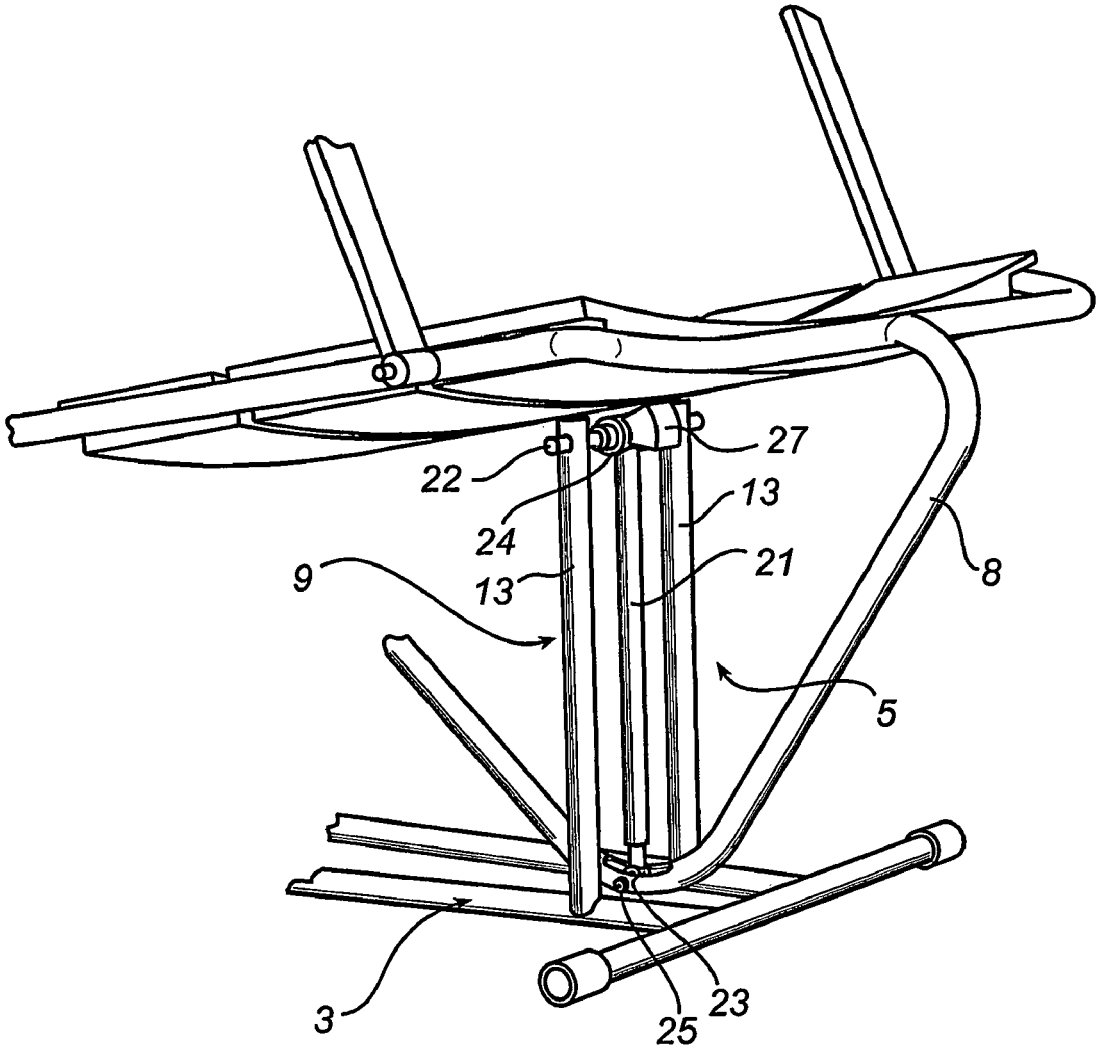
FIG. 2 is an enlargement of part of the swing mechanism.

With simultaneous reference to FIGS. 1*a*, 1*b* and 2, the frame 3 further comprises an upwardly extending supporting portion 9 in the form of two parallel supporting legs 13. The supporting portion 9 is adapted to form a fixing point and, thus, a pivot 22, for the swinging arm 21 included in a swing mechanism 5, which swing mechanism 5 will be described below. The supporting portion 9 may, of course, also consist of a single supporting leg 13. The supporting legs 13 are illustrated as essentially straight and with an essentially vertical orientation. The supporting legs 13 can, however, have an arbitrary extent and orientation but are to be designed in such a manner that the swing mechanism 5 can be arranged under the seat 2 with a satisfactory swinging motion.

The frame 3 is to be designed to provide sufficient strength and rigidity of the rocking chair 1.

Referring once more to FIGS. 1*a* and 1*b*, a leg 4 is shown arranged between the seat 2 and the frame 3 in such a manner that its first upper end 14 is articulated to the seat 2 and its second lower end 15 is articulated to the rear part of the frame 3. The leg 4 has an essentially upright position.

In the illustrated embodiment, the leg 4 consists of two parallel tubular sections 16 having a certain curvature. By the leg 4 being provided with a curvature, a clearance between the backrest 7 and the leg 4 can be ensured, whereby the rocking motion is not limited by the leg 4 abutting against the backrest 7. The clearance further ensures that objects coming in between the two parts cannot be damaged or injured by squeezing. The curvature can also be made so as to make the rocking chair 1 compact and, above all, aesthetically attractive.

The use of two parallel tubular sections 16 results in a somewhat more stable leg construction compared with the case where only one tubular section would be used. The two tubular sections 16 included in the leg 4 are connected to each other by means of an upper and a lower crossbar 17, 18. The crossbars 17, 18 form shafts by means of which the leg 4 is articulated to the seat 2 and the frame 3, respectively. The described tubular section can in an alternative embodiment be an essentially sheet-shaped element.

More specifically, the first end 14 of the leg 4 is articulated to the seat 2 via its backrest 7 in a bearing 19 arranged therein. The articulated attachment to the seat 2 is preferably arranged on the back of the backrest 7 of the seat 2 and advantageously in the upper part thereof.

The second end 15 of the leg is articulated to the rear end of the frame 3 via the lower crossbar 18 of the leg 4, which crossbar is mounted in bearings 20 between the longitudinal struts 11 that extend between the two transverse supporting surfaces 10 included in the frame 3.

Like in the shown embodiment, the leg 4 can be rigid, but can also be provided with an adjustable and lockable knee joint or be telescopic (not shown). A leg 4 with an adjustable/lockable knee joint or a telescopic function allows adjustment of the linear distance between the two ends 14, 15 of the leg and, thus, the distance between the fixing points of the leg on the seat 2 and the frame 3, respectively. By adjusting the linear distance between the two ends 14, 15 of the leg 4, a certain degree of angling of the bottom 6 of the seat 2 relative to the horizontal plane is allowed.

Referring once more to FIG. 2, an enlargement of the swing mechanism 5 of the rocking chair 1 is shown.

The swing mechanism 5 comprises a swinging arm 21 which for the purpose of illustration has a first end attached to a pivot 22 on which the swinging arm 21 can pivot, and a second opposite end which below will be referred to as the free end 23 of the swinging arm.

The swinging arm 21 is arranged with its pivot 22 at the free end of the upwardly extending supporting portion 9 of the frame 3.

The free end 23 of the swinging arm 21 is articulated to the previously mentioned projection 8 which is arranged on the underside of the seat 2. The free end 23 of the swinging arm is more specifically attached to the projection 8 in the lower part thereof facing away from the bottom, which lower part in the shown embodiment is the web of the projection 8.

The attachment of the swinging arm 21 to the frame 3 and the seat 2 can be arranged in various ways, for instance by ball bearings. Other suitable attachments will be realised by those skilled in the art.

To allow a thus attached swinging arm 21, the distance between the fixing point of the swinging arm 21 in the projection 8 and the underside of the seat 2 must exceed the length of the swinging arm 21. Moreover the supporting portion 9 of the frame 3 is to have a length that exceeds the length of the swinging arm 21.

Thus the seat 2 and the frame 3 are interconnected on the one hand by means of the leg 4 and, on the other hand, by the swinging arm 21 being arranged with its pivot 22 at the free end of the supporting portion 9 of the frame and with its free end 23 in that part of the projection 8 which faces away from the bottom 6. The free end 23 of the swinging arm 21 is, in other words, arranged below the pivot 22 of the swinging arm 21.

In the embodiment illustrated, the swing mechanism 5 comprises a swinging arm 21. The swing mechanism 5 may also comprise a plurality of swinging arms 21 depending on the design of the rocking chair 1 and, in particular, depending on the width of the seat 2. In the case where a plurality of swinging arms 21 are arranged, they must be arranged with their pivots 22 on a straight line seen in the transverse direction of the rocking chair 1. This straight line must also be perpendicular to the longitudinal direction of the seat 2.

If a plurality of swinging arms 21 are used, the pivots 22 are advantageously arranged on a common axis to facilitate mounting. Moreover it is preferred for a projection 8 to be arranged for each swinging arm 21.

Referring once more to FIGS. 1*a* and 1*b*, it is essential for the invention that the leg 4 be considerably longer than the swinging arm 21. By the length of the leg 4 is here meant the linear distance between its fixing points 14, 15 in the seat 2 and the frame 3, respectively. This is necessary to obtain a motion pattern which gives the user of the rocking chair 1 a comfortable, even and long rocking motion. The ratio of the length of the swinging arm 21 to that of the leg 4 is preferably in the order of 1:2 to 1:4, and most preferred in the order of 1:3. The leg can, for example, have a length of 90 cm and the swinging arm 21 a length of 30 cm.

The swinging arm 21 is preferably of a rigid type in the form of, for example, a tubular section. The swinging arm 21 can also be flexible and made of, for example, saddle girth or a hard rubber band.

The advantage of a flexible swinging arm 21 is that its attachment to the frame 3 and the seat 2, respectively, can be made very simple without necessitating ball bearings for example. The flexible swinging arm 21 can, for instance by sewing, be provided with loops at its ends, thus allowing it to be slipped onto shafts to be attached to the supporting portion and the projection, respectively. A flexible swinging arm 21 can also be attached to and around a shaft, which allows that part of the flexible swinging arm 21 which is arranged adjacent to the shaft to make a rolling motion about the shaft during the swinging motion. Such a construction results in a practically friction-free swinging motion. Such a shaft advantageously is essentially circular or oval in cross-section.

A flexible swinging arm 21 also allows a certain elastic motion in its longitudinal direction which by the user of the rocking chair 1 can be experienced as comfortable.

The rocking chair 1 is preferably arranged with armrests 26. The armrests 26 can, depending on their construction, increase the rigidity of the seat 2 and make the rocking chair 1 safer while at the same time they give the user a more relaxing position in the rocking chair 1.

The bearings 19, 20, 24, 25 appearing in the rocking chair are preferably of a ball bearing type. The bearings 19, 20, 24, 25 can be made in different combinations and of different materials depending on the intended applications of the chair and the loads to which it is subjected and depending on the attachment of the swing mechanism 5 to the frame 3 and the projection 8, respectively.

In an alternative embodiment, the bottom 6 and the backrest 7 are articulated to each other to provide a rocking chair 1 with an adjustable seat (not shown).

The seat 2 can be provided with cushions or similar stuffed fabrics (not shown) to give the user a comfortable experience in the rocking chair.

The outside of the rocking chair can be coated with, for example, textile fabrics which give the viewer the impression of an ordinary armchair. Such textile fabrics may consist of, for example, padding and cloth. The rocking chair can also be provided with, for example, an outer cover consisting of leather or some other suitable material (not shown).

A locking mechanism (not shown) can in an alternative embodiment be arranged to be easy of access for the user to lock the seat 2 in a desired position so as to prevent a rocking motion. In a preferred embodiment, a locking lever is provided on the side of the seat. The locking lever is preferably by means of a link system connected to a locking mechanism locking the seat 2 to the frame 3, thereby obtaining a fixed seat 2. Such a locking mechanism can be used, for example, when the user is to sit down on or rise from the rocking chair. The locking mechanism can also be applicable when a fixed installation is desired, for instance when there are children around the rocking chair or on other occasions when a movable seat 2 is not desired.

Figure 3A:
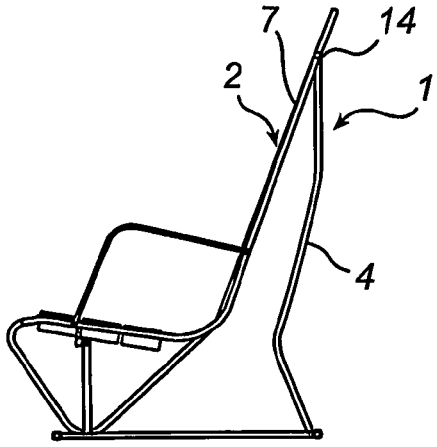
FIG. 3*a* is a side view of the rocking chair with the seat in a position of rest.
Figure 3B:
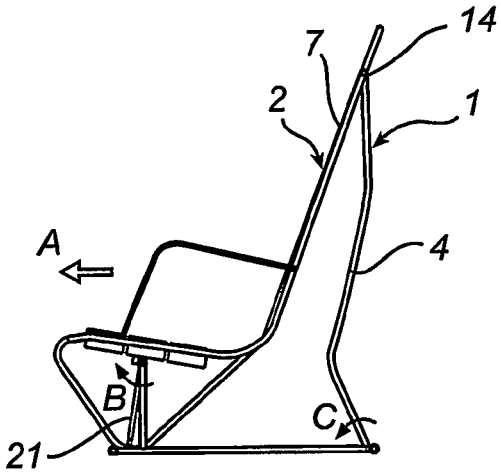
FIG. 3*b* is a side view of the rocking chair with the seat in a front end position.
Figure 3C:
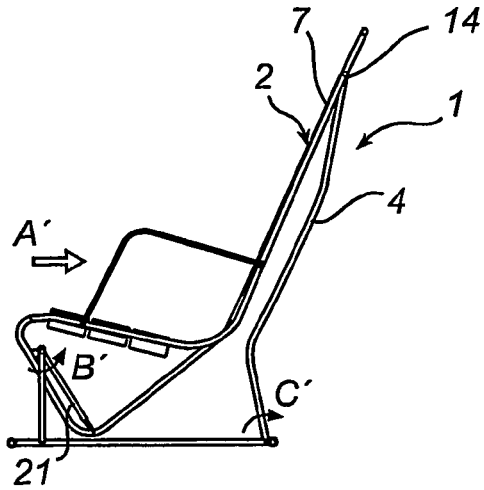
FIG. 3*c* is a side view of the rocking chair with the seat in a rear end position.

FIGS. 3*a*-3*c* illustrate a rocking chair 1 in three different positions. FIG. 3*a* shows the rocking chair 1 from the side in a position of rest. FIGS. 3*b* and 3*c* illustrate the rocking chair 1 in a front and a rear end position respectively.

In FIG. 3*a*, the chair 1 is not subjected to a load and is without a user. With the user sitting in the chair 1, the position of rest can be changed somewhat depending on the weight and sitting posture of the user. FIG. 3*b* shows the chair in a front end position. Arrow A indicates in which direction the seat has moved relative to the position of rest in FIG. 3*a*. Arrows B and C indicate the direction in which the swinging arm 21 and the leg 4, respectively, have been angled relative to the position of rest. The motions are analogously described in FIG. 3*c*, where arrow A' indicates the motion of the seat 2 relative to the position of rest and arrows B' and C' indicate the angling of the swinging arm 21 and the leg 4, respectively, relative to the position of rest.

The user sets the seat in motion by foot power, thus giving the seat 2 a reciprocating motion. The first end 14 of the leg 4, which is connected to the backrest 7, moves in the direction chosen by the user. In a forward motion according to FIG. 3*b*, the first end 14 of the leg 4 passes an unstable position of equilibrium which gives a forward force to the seat. The unstable position of equilibrium is in the position where the first end 14 of the leg 4 is at its highest point relative to the floor surface, i.e. the seat 2 does not return by itself to the position of equilibrium without being acted upon. The longer the motion proceeds the greater the angle of the swinging arm 21. An increased angle of the swinging arm 21 results in a greater backward force, which in turn forces the seat 2 backwards, which then passes the unstable position of equilibrium. In the position of rest, practically no horizontal forces act on the swinging arm 21, and instead these forces consist essentially of vertical forces. The motion now proceeds to a rear position according to FIG. 3*c* in which the horizontal forces, analogously with FIG. 3, increase in the swinging arm 21. To prevent too great a deflection in the rear end position, a stop 27 is preferably arranged adjacent the pivot 22 of the swing mechanism 5. The rocking motion continues as long as energy is supplied to the seat 2 by, for example, foot power. Also other forms of energy supplying means are conceivable, such as motor power.

To sum up, a rocking chair 1 is now provided, in which the rocking motion is performed by means of a swing mechanism 5 which cooperates with a leg 4. This allows a rocking chair 1 which, by means of the leg 4 with a swinging radius which is greater than the swinging motion of the swinging arm 21, gives a motion pattern which is limited by the end positions of the swinging arm 21. The construction allows a stable and at the same time slender rocking chair 1. The design of the rocking chair 1 also allows a construction where the risk of injuries caused by squeezing is practically non-existent.

The invention is not restricted to rocking chairs for one person but can also be intended for several persons, for instance in the form of a rocking garden bench or the like.

The device can also be used for other kinds of furniture where a comfortable rocking motion is desired, such as a bed to facilitate falling asleep. The bottom may thus also consist of a bunk or the like.

The selection of materials for the rocking chair 1 should not restrict the invention. The material can be wood, metal or plastic, and also other materials may be convenient.

It will further be appreciated that the rocking chair 1 can be constructed with other structural elements than the tubular sections described.

It will be appreciated that the present invention is not limited to the embodiments shown. Several modifications and variations are thus feasible, and the invention is consequently defined exclusively by the appended claims.

The invention claimed is:

1. A rocking chair comprising:

a frame and a seat swingable relative to the frame, a leg comprising a first upper and a second lower end, which first end is articulated to the seat and which second end is articulated to the frame, and a swing mechanism comprising a swinging arm having a pivot arranged in the frame and a free end articulated only to the seat in such a manner that the free end of the swinging arm is arranged below the pivot of the swinging arm.

2. A rocking chair as claimed in claim 1, in which the leg has a significantly greater swinging radius than the swinging arm.

3. A rocking chair as claimed in claim 2, in which the ratio of the length of the swinging arm to the length of the leg preferably is in the order of 1:2 to 1:4 and most preferred in the order of 1:3.

4. A rocking chair as claimed in claim 1, in which the leg is articulated to the seat via a backrest included in the seat.

5. A rocking chair as claimed in claim 1, in which the free end of the swinging arm is articulated to the seat via a projection arranged on an underside of the seat.

6. A rocking chair as claimed in claim 1, in which the pivot of the swinging arm is arranged on a supporting portion extending upright from supporting points of the frame on a base.

7. A rocking chair as claimed in claim 1, in which the swinging arm is rigid.

8. A rocking chair as claimed in claim 1, in which the swinging arm is flexible.

9. A rocking chair as claimed in claim 1, in which the linear distance between the first and second ends of the leg is adjustable to set the inclination of the seat relative to a horizontal plane.

10. A rocking chair as claimed in claim 1, comprising a locking mechanism for locking the position of the seat relative to the frame.

* * * * *